US008844543B2

(12) United States Patent
Bickford et al.

(10) Patent No.: US 8,844,543 B2
(45) Date of Patent: Sep. 30, 2014

(54) CONCAVE-CONVEX ROLLER ASSEMBLY

(75) Inventors: William R. Bickford, Ronkonkoma, NY (US); Anne T. Carullo, New York, NY (US); Herve F. Bouix, New York, NY (US)

(73) Assignee: ELC Management LLC, New York, NY (US)

( * ) Notice: Subject to any disclaimer, the term of this patent is extended or adjusted under 35 U.S.C. 154(b) by 57 days.

(21) Appl. No.: 13/216,490

(22) Filed: Aug. 24, 2011

(65) Prior Publication Data

US 2013/0048011 A1 Feb. 28, 2013

(51) Int. Cl.
*A45D 40/26* (2006.01)
*A45D 34/04* (2006.01)

(52) U.S. Cl.
CPC ..... *A45D 34/041* (2013.01); *A45D 2200/1018* (2013.01)
USPC ..... 132/320

(58) Field of Classification Search
USPC ..... 132/320, 317, 318; 15/118, 230.11, 15/230.18; 492/13, 19; 601/119, 120
See application file for complete search history.

(56) References Cited

U.S. PATENT DOCUMENTS

| | | | |
|---|---|---|---|
| 1,501,342 | A | 7/1924 | Hoard |
| D105,722 | S | 8/1937 | Widmann |
| D113,690 | S | 3/1939 | Tresenberg |
| D166,427 | S | 4/1952 | Strock |
| 3,157,135 | A | 11/1964 | Fetrow et al. |
| D211,549 | S | 6/1968 | Christopher |
| D214,608 | S | 7/1969 | Howell et al. |
| 3,638,939 | A | 2/1972 | Langley |
| D260,560 | S | 9/1981 | Flower |
| 4,335,483 | A | 6/1982 | Buck |
| D299,972 | S | 2/1989 | Moore |
| 5,176,754 | A | 1/1993 | Hirzel |
| 5,218,955 | A | 6/1993 | Gueret |

(Continued)

FOREIGN PATENT DOCUMENTS

KR 20090006899 7/2009

OTHER PUBLICATIONS

PCT International Search Report; International Application No. PCT/US2012/051877 Completion Date: Jan. 31, 2013; Mailing Date: Jan. 31, 2013.

(Continued)

*Primary Examiner* — Rachel Steitz
(74) *Attorney, Agent, or Firm* — Cynthia R. Miller

(57) ABSTRACT

A dual-ended applicator is provided. The applicator includes a handle, a first roller having a broad concave surface at one end of the handle, and a second, ball-like roller having a convex surface, at the opposite end of the handle. The first roller, having a greater axial length and surface area than does the second roller is intended for applying a cosmetic to broader convex areas of the skin. The second roller, having a lesser axial dimension and surface area as compared with the first roller is intended for distributing a cosmetic to the narrower, concave areas of the skin. The first roller is mounted on the applicator so as to rotate about a fixed axis lateral to the longitudinal axis of the applicator, and will move in straight paths along the skin, in line with the longitudinal axis of the applicator. The second, ball-like roller is mounted on the applicator so as to travel along both straight and curved paths, automatically adjusting between positions as the applicator is moved along the skin surface.

24 Claims, 6 Drawing Sheets

(56) References Cited

U.S. PATENT DOCUMENTS

| | | | | |
|---|---|---|---|---|
| D341,427 | S | 11/1993 | Koll | |
| 5,410,773 | A * | 5/1995 | Forkner | 15/230.11 |
| D363,377 | S | 10/1995 | Koptis | |
| D414,875 | S | 10/1999 | Sirois et al. | |
| D459,639 | S | 7/2002 | Hefti et al. | |
| 6,484,341 | B2 | 11/2002 | Hefti et al. | |
| D535,893 | S | 1/2007 | Shurtleff et al. | |
| 7,169,120 | B2 | 1/2007 | Murdock et al. | |
| D549,834 | S | 8/2007 | Huang | |
| 7,435,029 | B1 | 10/2008 | Marini | |
| D617,943 | S | 6/2010 | Boulx et al. | |
| D631,192 | S | 1/2011 | Lim | |
| 7,896,824 | B2 | 3/2011 | Gueret | |
| D654,811 | S | 2/2012 | Song | |
| D659,549 | S | 5/2012 | Fera et al. | |
| D661,168 | S | 6/2012 | Furling et al. | |
| D665,642 | S | 8/2012 | Furling et al. | |
| D669,590 | S | 10/2012 | Matsushita | |
| 2005/0131320 | A1 | 6/2005 | Lee | |
| 2008/0014012 | A1 | 1/2008 | Le Guenic et al. | |
| 2009/0158529 | A1 | 6/2009 | Vaes | |

OTHER PUBLICATIONS

PCT Written Opinion of the International Searching Authority; International Application No. PCT/US2012/051877; Completion Date: Jan. 31, 2013; Mailing Date: Jan. 31, 2013.

* cited by examiner

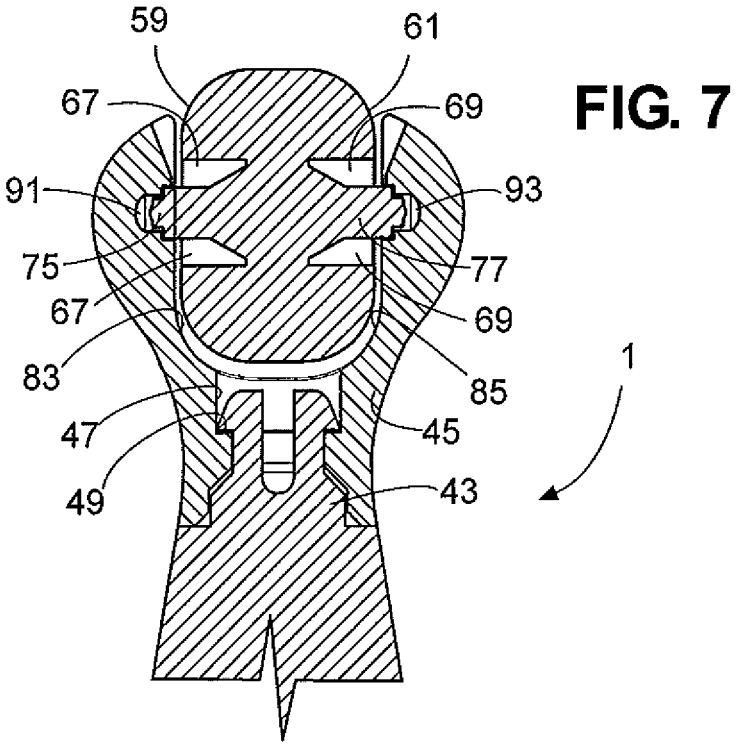
FIG. 7
FIG. 8
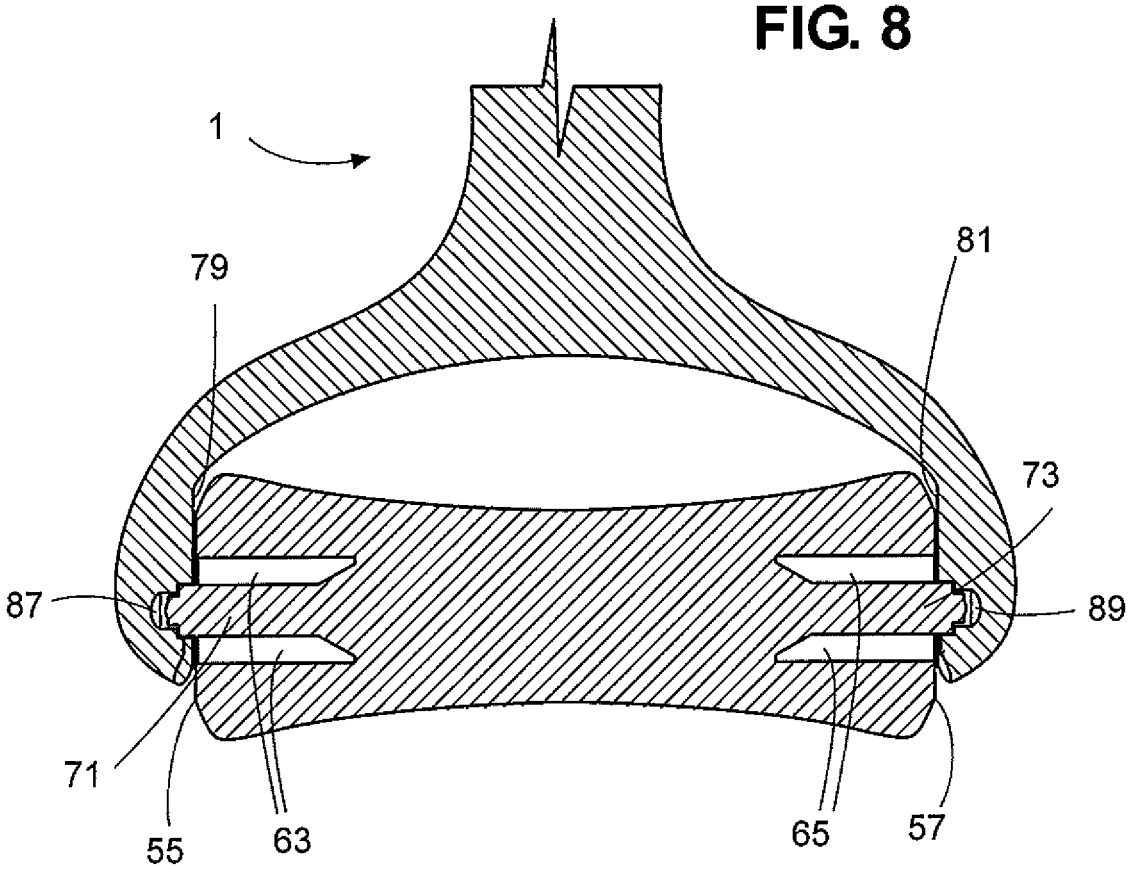

CONCAVE-CONVEX ROLLER ASSEMBLY

FIELD OF THE INVENTION

The present invention concerns the field of cosmetic applicators, and in particular, cosmetic applicators for applying a foundation to the skin of a user's face and/or neck. More particularly, the invention concerns a roller assembly having two distinct and specialized ends specifically adapted to apply foundation to the skin to create a smooth transition from one part of the face and/or neck to another.

BACKGROUND OF THE INVENTION

Creating a successful look with makeup depends not only on the product type and color but on its application to the skin. Selection and proper use of the right tool can enhance the user's natural beauty, evening skin tone and de-emphasizing flaws. An observer should not see where the foundation begins and ends.

Makeup, specifically, liquid or cream foundations, can be applied to the face and/or neck skin using the fingers, or a variety of tools or applicators. Applicators for applying cosmetics are well-known and include sponges, tufts of bristles, and rollers. These applicators generally provide a more even distribution of makeup than is possible using the fingers; however, applicators are not without their problems. Sponges, especially those having a wedge shape, are useful for distributing makeup into difficult or tight areas, such as around the nose and eyes; however, sponges can harbor bacteria and further tend to deteriorate. For these reasons, it is advisable that, if sponges are used, these should be of the disposable variety. However, replacing the sponges can be costly. An additional disadvantage to sponges is that some contain latex, a product to which many are allergic. Brushes, carrying tufts of bristles, do not permit foundation to be blended properly and can result in streaking. Available roller-type applicators include a cylindrical roller which does not provide an even distribution of makeup, especially around the nose and the eyes, and can result in streaking. As examples of roller devices, reference may be made to U.S. Pat. Nos. 1,501,342; 3,157,135; 3,638,939; 4,335,483; 6,484,341; 7,435,029; Des. 113,690; Des. 299,972; and Des. 459,639. There continues to be a need for a cosmetic applicator that will result in a seamless application of foundation to all areas of the facial and neck skin.

SUMMARY OF THE INVENTION

To overcome the deficiencies in the prior art, a dual ended applicator for evenly applying a cosmetic to a skin surface is provided. The applicator has a handle having a longitudinal axis and opposite ends. A first rolling member has a concave surface and a first axial dimension and is mounted at one end of the handle for rotation about a fixed axis extending laterally of the longitudinal axis of the handle. A second rolling member has a convex surface and a second axial dimension and is rotatably mounted at the opposite end of the handle. The axial dimension of the first rolling member is greater than the axial dimension of the second rolling member. The applicator further includes means for mounting the first and second rolling members to respective opposite ends of the handle.

The means for mounting each of the first and second rolling members to the handle may comprise at least one support having a rolling member-engaging end and a handle-engaging end and at least one supporting member for the rolling member extending from the rolling member-engaging end of the support and allowing for rotation of the rolling member.

BRIEF DESCRIPTION OF THE DRAWINGS

FIG. 7 is partial sectional view of the applicator shown in FIG. 2 with a detailed view of articulation of the support for the second rolling member with the handle;

FIG. 8 is a partial sectional view of the applicator shown in FIG. 2, with detailed views of the articulation of the first and second rolling members with the respective supports;

DESCRIPTION OF THE PREFERRED EMBODIMENTS OF THE INVENTION

Figure 1:
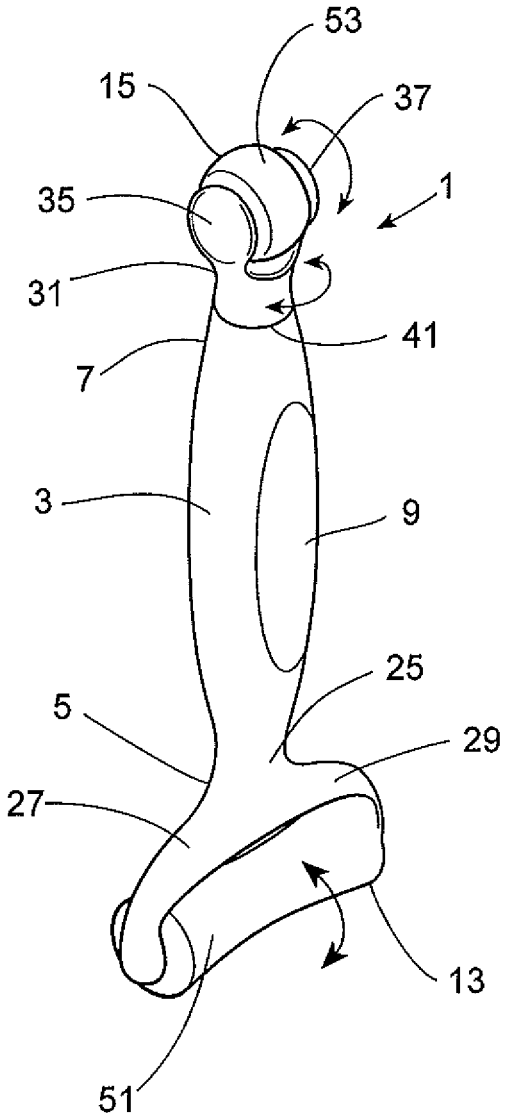
FIG. 1 is a perspective view of a first embodiment of an applicator according to the invention.

The present invention concerns an applicator for applying a cosmetic, and in particular, the invention relates to a double-ended roller applicator for applying a cosmetic to the skin of the face and the neck. The majority of roller applicators on the market have a cylindrical geometry, indicating that a flat applicator surface will be applied to skin surfaces having compound curves. A flat application is not be suitable for evenly coating flexible convex or concave surfaces such as the skin of the face and neck with a makeup foundation, and is likely to leave streaks or areas of inconsistent makeup thickness or uniformity on the skin. To overcome the deficiencies of known applicators, the present invention provides an applicator in the form of a concave-convex roller assembly, including a first rolling member and a second rolling member. The first rolling member has a greater surface area and axial dimension than does the second rolling member. The first rolling member, having a broad concave surface with rounded edges, is designed to closely follow the profile of the skin on broad, minimally detailed areas of the face, such as the cheeks, the chin and forehead, and the neck. The detailed, deep or confined areas of the face can be effectively covered by a second, smaller, "ball-like" convex rolling member. The term "ball-like" is intended to include any structure which is capable of demonstrating the freedom of rotation associated with a roller ball. Thus, the second rolling member may be described as a ball, a wheel, or the like. Unlike fixed wheels, however, which move in a straight line, the second rolling members of applicators according to the present invention, function like a ball and can move in any direction, making easy turns with minimal effort.

The cosmetic applicator of the present invention therefore has two distinct and specialized rolling members of different and specific shapes/contours disposed at opposite ends of the applicator to conform to the various aspects of the face; a broad concave rolling member for covering large surfaces of skin on the face, and a narrower convex, ball-like rolling member for blending makeup foundation into small, difficult to access detailed areas of the face. The applicator of the present invention is designed so that the rolling members work in a complentary fashion to provide complete and even coverage and blending across different skin surfaces. The "open" areas of the face that need uniform coverage are in fact convex surfaces that benefit from a concave roller surface in terms of receiving even coverage, including the cheeks, the chin, the forehead and the neck. The convex roller surface more easily conforms to the small, tight areas of the face such as the nose, and the eye areas having typically concave surfaces requiring detailed application. The combination of these two types of surfaces, a concave surface and a convex surface, and the concave surface being of greater axial dimension and/or surface area than the axial dimension and/or surface area of the convex surface, accommodates the entire face/neck, the rolling members complementing one another sufficiently to blend foundation in the areas where the different skin surfaces meet.

The applicator of the present invention therefore comprises a first rolling member having a broad concave surface at one end thereof and a second rolling member having a convex surface at the opposite end thereof, a handle, i.e., that portion of the applicator which separates the first and second rolling members, and means for mounting the first and second rolling members to opposite ends of the handle. The first rolling member has a greater axial length than does the second rolling member. The first rolling member is mounted on the applicator so as to rotate about a fixed axis lateral to the longitudinal axis of the applicator, and will move in straight paths along the skin, in line with the longitudinal axis of the applicator. The second rolling member is mounted on the applicator so as to travel along both straight and curved paths, automatically adjusting between positions as the applicator is moved along the skin surface.

Figure 2:
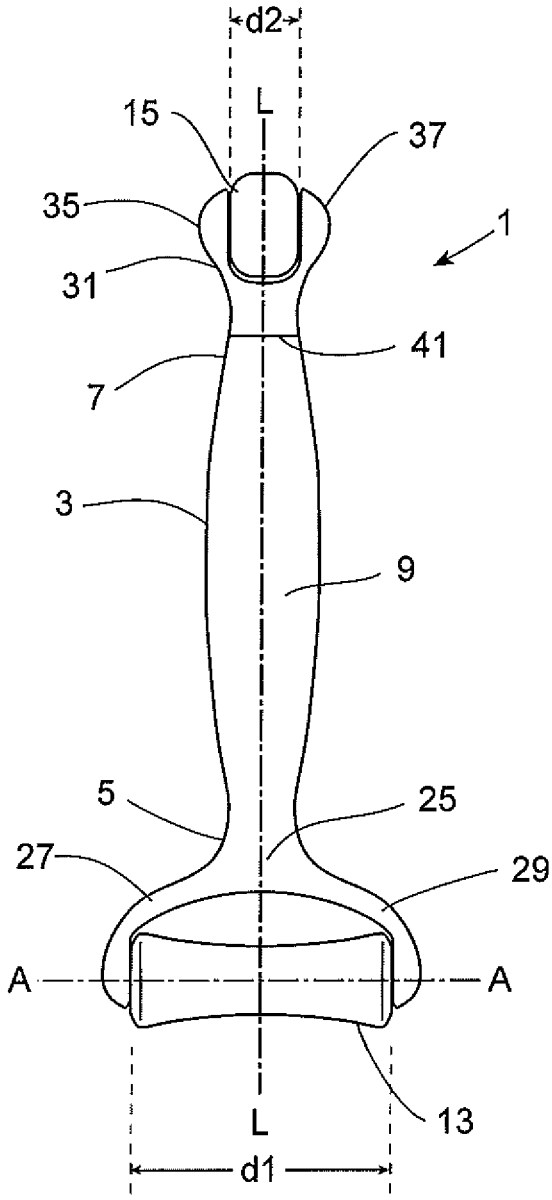
FIG. 2 is front elevational view of the applicator shown in FIG. 1.
Figure 3:
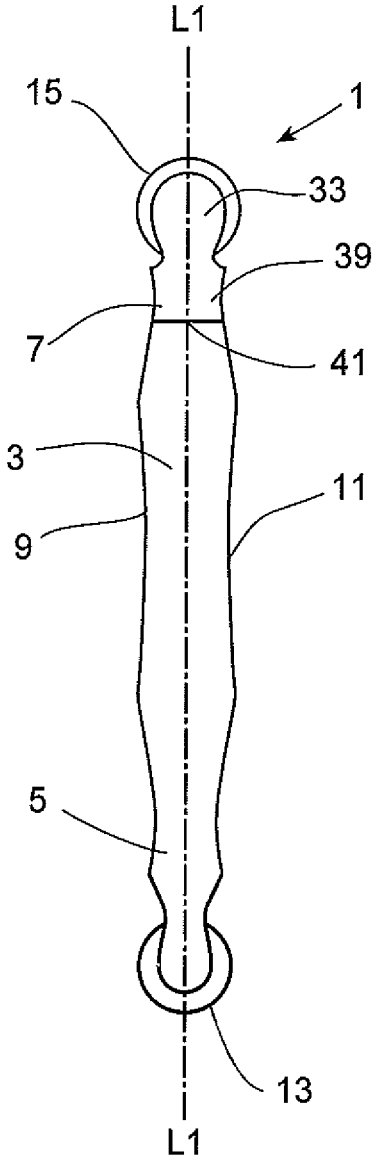
FIG. 3 is a side elevational view of the applicator shown in FIG. 1.
Figure 4:
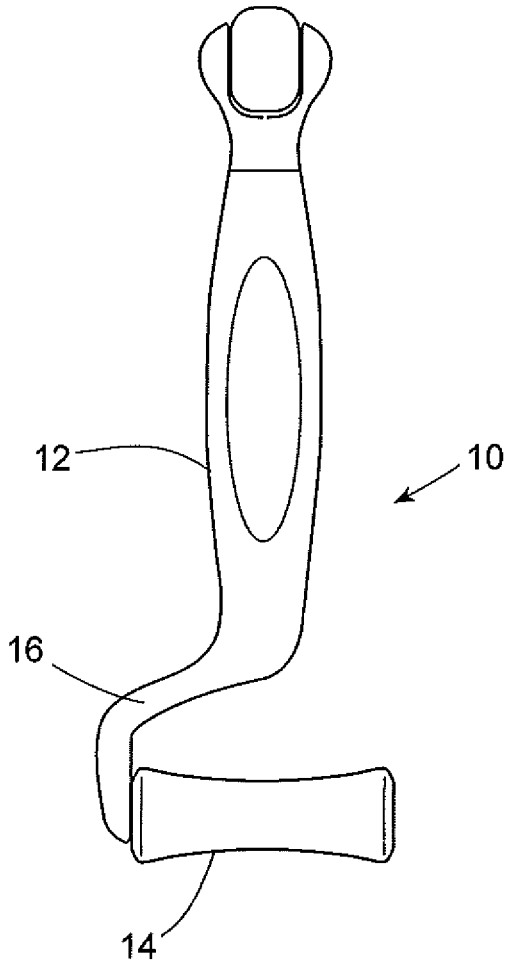
FIG. 4 is a partial front elevational view of a second embodiment of an applicator according to the invention.

In accordance with a preferred embodiment of the present invention, as shown in FIGS. 1-3, applicator 1 comprises a handle 3 having a longitudinal axis L and opposite ends 5, 7. Handle 3, which is designed to be compact and ergonomic, i.e., contoured to facilitate gripping by the user, is provided with recesses 9, 11. A first rolling member 13 is secured to one end 5 of the handle 3 and a second rolling member 15 is secured to the opposite end 7 of handle 3, by supports 25, 31, respectively. Although the first and second supports 25, 31 are illustrated as yokes, i.e., two-armed supports, it would be appreciated by those skilled in the art that the rolling members may be supported by any suitable means allowing for the rotation of the respective rolling members. As an example, the at least one support for the first rolling member, the second rolling member, or both, may be a one-armed support. As an example, and as shown in the partial view in FIG. 4, applicator 10, having a handle 12, is provided with first rolling member 14, mounted on a one-armed support 16.

Referring to FIGS. 1-3, first yoke 25 has a first pair of spaced arms 27, 29 allowing the first rolling member 13 to rotate about a fixed axis A which is disposed lateral to the longitudinal axis L of the handle 3. The second rolling member 15, in the form of a wheel, is rotatably mounted to the handle 3 by means of the second yoke 31. Second yoke 31 has a rolling member-engaging end 33, including a second pair of spaced arms 35, 37, and a handle-engaging end 39. The second yoke 31 has a longitudinal axis L1 which is in alignment with longitudinal axis L of handle 3. The second yoke 31 rotates or swivels 360° relative to an intersection 41 of longitudinal axes L and L1, thus also allowing the second rolling member 15 to rotate radially relative to intersection 41.

Figure 5:
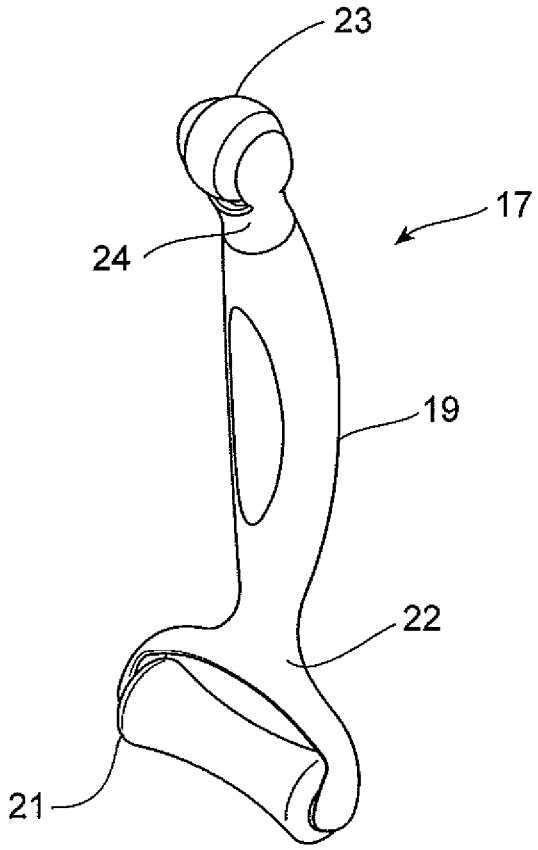
FIG. 5 is a perspective view of a third embodiment of an applicator according to the invention.
Figure 6:
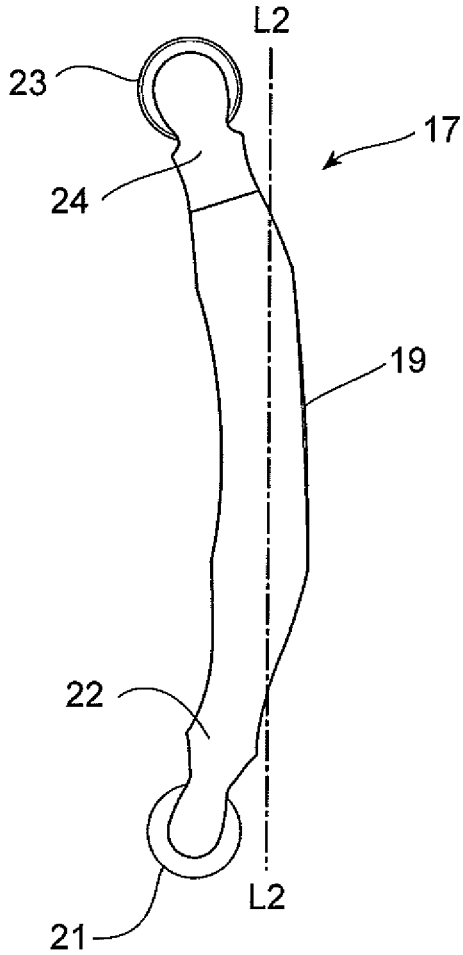
FIG. 6 is a side elevational view of the applicator shown in FIG. 5.

As further indicated in FIGS. 1-3, first and second yokes 25, 31 and first and second rolling members 13, 15 are shown in alignment with longitudinal axis L but need not be. Thus, in accordance with a further embodiment of the applicator of the present invention, as shown in FIGS. 5 and 6, applicator 17 includes a curved handle 19, having a longitudinal axis L2, and first and second rolling members 21, 23 rotationally mounted on first and second yokes 22, 24, respectively. First and second yokes 22, 24 and first and second rolling members 21, 23 are offset from longitudinal axis L2. It would also be understood by those skilled in the art that, whether or not the handle is curved, one of the first and second rolling members may be in alignment with the longitudinal axis of the handle while the other of the first and second rolling members may be offset from the longitudinal axis of the handle. Additionally, the first and second rolling members may be offset from the longitudinal axis of the handle in the same direction or in opposite directions.

Applicators according to the present invention preferably have a length in the range of from about 75 mm to about 100 mm, such as from about 85-95 mm. The first rolling member may have an axial dimension (length) which is in the range of from about 25 mm to about 30 mm, with a diameter in the range of from about 8 mm to about 12 mm. The second rolling member may have an axial dimension (width) which is in the range of from about 6 mm to about 10 mm, and a diameter in the range of from about 9 mm to about 14 mm. Therefore, the axial length of the first rolling member is less than the axial length of the second rolling member. In preferred embodiments of the present invention the ratio of the axial dimension of the first rolling member to the axial dimension of the second rolling member is in the range of from about 2:1 to about 5:1, for example, from about 3:1 to about 4:1.

As shown in FIGS. 1-3, the spaced arms 27, 29 of the first yoke 25 are separated by a distance d1 which is sized to accommodate the first rolling member 13, while the spaced arms 35, 37 of the second yoke 31 are separated by a distance d2 which is sized to accommodate the second rolling member 15. The distance d2 is less than the distance d1, and, therefore, d1 to d2 is in the range of from about 2:1 to about 5:1, for example, from about 3:1 to about 4:1.

The handle 3 and the first yoke 25 may be of a unitary construction. However, other suitable means of engagement are possible. As non-limiting examples, the handle 3 and the first yoke 25 could be integrally molded from different materials, or the first yoke 25 could be snap-fit to the handle 3.

The second yoke 31 may be secured to the handle 3 by any suitable means known in the art which will allow the second yoke 31 to rotate freely or swivel 360° in either direction relative to the intersection 41 of longitudinal axes L and L1 of the handle 3 and the second yoke 31, respectively. Such means may comprise, but are not limited to, a gimbal mount; a universal joint; a knuckle joint; a dual joint, or the like. In a preferred embodiment of the applicator shown in FIGS. 1-3, and, as best illustrated in the partial sectional view shown in FIG. 7, the means engaging the second yoke 31 with handle 3 comprises a dual joint including, for example, an annular knob-like projection 43 extending from handle 3 for mating engagement with a sleeve 45 of second yoke 31, the sleeve 45 having an inner wall 47, which is dimensioned to receive annular knob-like projection 43 of handle 3. The inner wall 47 of sleeve 45 may further comprise an annular ledge 49 for maintaining the knob-like projection 43 in snap-fitting engagement with sleeve 45. It also would be readily understood by those skilled in the art that, alternatively, the dual joint could comprise a sleeve extending from the applicator handle for accommodating a knob-like projection extending from the handle-engaging end of the second yoke.

Referring to FIGS. 1-3, the first rolling member has an application surface 51 (i.e., the portion of the rolling member which is particularly shaped and adapted for application of a cosmetic product) which resembles a cylinder that is concave from its end shoulders towards its central axis. It would be readily appreciated by those skilled in the art that the geometry of the first rolling member could resemble a curve of a circle, an ellipse, a parabola, a roulette, a cycloid (i.e., a curve defined by the path of a point on the edge of a circular wheel as the wheel rolls along a straight line), or a cissoid curve that is rotated around the central axis. Thus, the curve is symmetric on a plane at the midpoint of the length of the cylindrical profile and the plane is perpendicular to the central axis of the cylinder. Preferably, the range of concavity or bowing towards the central axis is either an ellipse or the shape of a cycloid curve. The second rolling member 15 has a convex application surface 53 resembling a wheel.

For ease of illustration, the first rolling member 13 and the second rolling member 15 are shown as axially symmetric, the first rolling member 13 being symmetric across its length, and the second rolling member 15 being symmetric across its width. However, it would be readily recognized that the rolling members 13, 15 may also be asymmetric as long as each has an effective convex and concave profile conducive to skin application. It is believed that this range of shapes conforms to the most common compound curves/surfaces on the face and neck.

The at least one support for mounting each of the first and second rolling members to the handle may further comprise at least one supporting member allowing for rotation of the rolling members on their respective supports. Such supporting members may comprise any suitable means known in the art, and include, but are not limited to, axles; pins; magnetic connectors; cooperatively mating structures, such as projections and recesses; and the like. In one preferred embodiment of the applicator of the present invention, the connecting means are cooperatively mating structures. In a preferred embodiment of the applicator of FIGS. 1-3, as best illustrated in the partial sectional views shown in FIGS. 7 and 8, the cooperatively mating structures comprise projections and recesses. Opposite surfaces 55, 57; 59, 61 of the first and second rolling members 13, 15, respectively, may each include respective annular internal clearances 63, 65; 67, 69, defining respective knob-like projections 71, 73; 75, 77. Inner surfaces 79, 81; 83, 85 of each pair of spaced arms 27, 29; 35, 37, respectively, of the first and second yokes 25, 31, respectively, are provided with respective recesses 87, 89; 91, 93, each recess being dimensioned to receive and rotatably retain a corresponding knob-like projection 71, 73; 75, 77 in cooperatively mating engagement. Preferably, the projections and the recesses are formed of relatively elastic materials, the annular internal clearances in the rolling members enhancing the flexibility of the projections and recesses, such that each knob-like projection may be mated in snap-fitting engagement with a corresponding recess by applying sufficient force.

Figure 9:
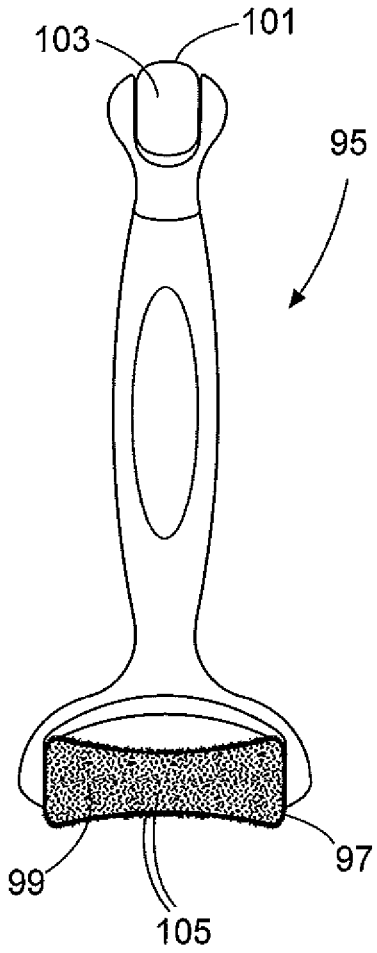
FIG. 9 is a front elevational view of a fourth embodiment of an applicator according to the invention.
Figure 10:
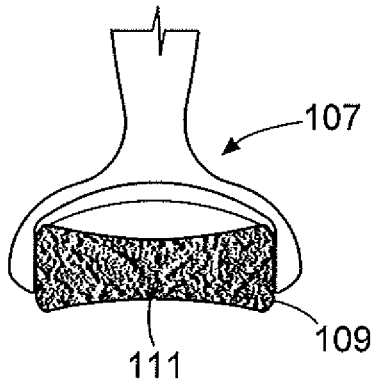
FIG. 10 is a partial elevational view of a fifth embodiment of an applicator according to the invention.
Figure 11:
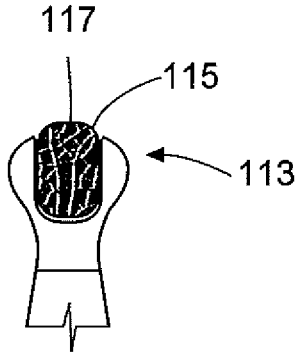
FIG. 11 is a partial elevational view of a sixth embodiment of an applicator according to the invention.

In other preferred embodiments of the present invention, once an applicator according to the present invention is molded, flock may be applied to one or both of the first and second rolling members. The process of flocking is a standard one, well-known in the art. Short fibers or particles, which may be of any commonly used material, such as nylon, polyester, or any natural fiber, are applied with an adhesive, such as an epoxy, to the surface to be flocked. Preferably, the flocking process takes place in an electrostatic field, which results in the proper orientation of the fibers which typically have a height of about 0.25-0.3 mm. The flock on the application surface provides a convenient "reservoir" which can hold a desired amount of cosmetic product, such as foundation, for application to the skin of the face and/or neck. The product is loaded onto the flocking by simple rubbing of the product against the flock, such as by rolling the applicator surface along the surface of the product, for example, contained in a pan. As a non-limiting example, and as shown in FIG. 9, applicator 95 includes first rolling member 97 having an application surface 99, and second rolling member 101 having an application surface 103. Flock 105 is applied to the entire application surface 99 of first rolling member 97 for ease of receipt and delivery of product to the larger areas of the skin, such as the cheeks and forehead. The smooth (unflocked) application surface 103 of second rolling member 101 is useful for distributing product applied to the skin with the first rolling member 97 into the creases around the nose and around the eyes. Alternatively, the first rolling member surface may be smooth, while the second rolling member surface may be flocked. It also would be recognized, however, that the rolling member surfaces need not be flocked or smooth, but could be contoured, patterned or textured (e.g., raised or embossed, recessed or debossed, or a combination thereof), depending on the nature of the product to be applied and distributed on the skin. Non-limiting examples of alternative rolling member application surfaces are shown in FIGS. 10 and 11. The partial view shown in FIG. 10 illustrates an applicator 107 having a first rolling member 109 with an embossed application surface 111. As shown in the partial view in FIG. 11, applicator 113 has a second rolling member 115 with a debossed application surface 117.

It is particularly preferred, when the second rolling member is flocked and a relatively viscous cosmetic is to be applied to the skin, that the second yoke engage the handle in a manner which allows the flocked second rolling member to have the freedom of rotation which emulates a roller ball, but without the disadvantages attributable to the roller ball. Thus, the ability of a dual joint, for example, to rotate freely also enables the flocked second rolling member to move along straight and curved paths on the skin, and thus conform to and distribute product to tight areas of the face, such as creases around the nose, chin and eye areas. A conventional (unflocked) smooth roller ball is less well-adapted to distribute more viscous type products in these tight areas, since the ball relies on a minimum of friction between the ball and the cup or cradle that holds the roller ball in the applicator to move freely. The amount of friction would be too great between a plastic or metal ball which is flocked (and covered in product) and the cup that is holding it for the roller ball to move efficiently. Additionally, the area of contact of the roller ball with the skin would be limited to the opening in the cup. On the other hand, applicators of the present invention include a second rolling member, e.g., a wheel, which engages the handle by means of a dual joint, is free to rotate or swivel about multiple axes and thus function in a similar way to the roller ball but which will not be detrimentally affected by friction in the same way as is the roller ball. Moreover, the area of contact of the convex roller with the skin would be greater than when using the roller ball or ball-bearing type mechanism. Nevertheless, where flocking is not utilized, it would be readily understood by those skilled in the art that the roller ball would be entirely suitable for use as the second rolling member, particularly in applications in which a low viscosity cosmetic material is applied to the skin.

Figure 12:
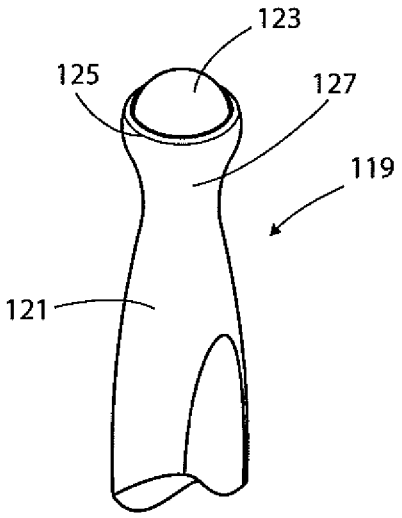
FIG. 12 is a partial perspective view of a seventh embodiment of an applicator according to the invention.
Figure 13:
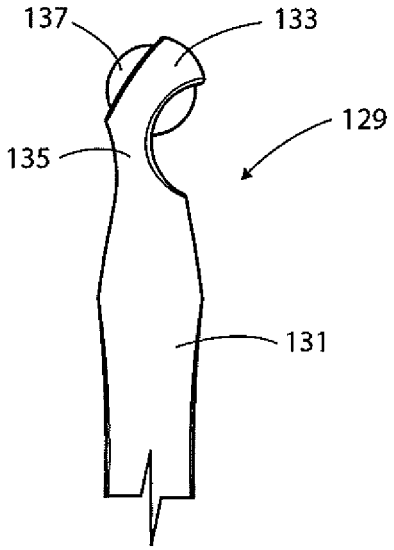
FIG. 13 is a partial front elevational view of an eighth embodiment of an applicator according to the invention.

Thus, in accordance with further embodiments of applicators according to the present invention, the second rolling member may be a ball. The ball may be secured to the applicator by any suitable means known in the art which will allow the ball to rotate freely or swivel about at an end of the applicator in any direction. Suitable means for securing the ball to the handle may include a ball and socket construction, as illustrated in the partial view shown in FIG. 12, of an applicator according to the present invention. Applicator 119 comprises a handle 121. Ball 123 may be pivotably accommodated in cup or socket 125 provided by an expanded end 127 of handle 121. An alternative means for securing a ball to an applicator is shown in partial view in FIG. 13. Applicator 129 comprises a handle 131. A loop element 133 is provided at an end 135 of handle 131 to pivotably accommodate a ball 137. Supports for the first rolling member may include, but are not limited to, those described hereinabove, such as, a single arm support, or a yoke comprising a pair of space spaced arms.

The applicators of the present invention may conveniently be made by injection molding, bi- or multi-injection molding, extrusion, vacuum forming, or thermoforming, casting or additive-manufacturing (layer by layer 3D printing) of thermoplastic or thermoset plastics, metals, ceramic, elastomers, or any of a variety or combination of ferrous or non-ferrous alloys or polymer resins common the cosmetic, pharmaceutical, treatment, or consumer goods packaging industries. Plastic materials suitable for injection molding may include, for example, styrene, acrylonitrile-butadiene styrene terpolymer (ABS), polymethylmethacrylate (PMMA), polyoxymethylene (POM), polypropylene (PP), polyethylene (PE) or polycarbonate (PC). In addition, the handle may be covered with a relatively more elastic material to provide the handle with a "soft-touch" grip (not shown). Suitable materials for the soft-touch grip are, for example, elastomer thermoplastics (e.g., Santoprene®) or silicone rubber.

The rolling members may be of solid construction and be formed of plastic, ceramic, metal, elastomeric material, foamed (cellular) material, and the like, of any density useful for applying a cosmetic to a skin surface. Preferably, when flocking will be applied, the rolling members are not formed from metal. The rolling members may also be composed of multiple materials; for example, the core could be rigid plastic and the surface of the rolling member could be elastomeric or flexible. These configurations could provide the rolling members with a degree of stiffness or with a combination of rollability such as a flexible plastic pin that rolls against the applicator, but will bend a small amount when in contact with the skin. Typically, the durometer of the materials forming the rolling members will be the range of from about 40 Shore A to about 72 Shore D. It will be appreciated that the applicator may be constructed so that the rolling members are removable for cleaning and/or replacement.

It will be recognized that although the applicators are described herein as well-adapted for use on the facial/neck skin area of a user; their use is not limited in this way, as the applicators may also be used with any eye, lip, facial, or body applicator technologies and methods common to the cosmetic, pharmaceutical, treatment, or consumer goods packaging industries. Thus, the applicator may be used in cosmetic, treatment, or pharmaceutical packages, for product delivery of for example, concealers, lip gloss/treatments, sun protection/tanning products, foundations, whitening products, lotions, anti-acne preparations, nail polish, skin cleansers/exfoliants, massaging and topical/skin care products.

While the invention has been described and illustrated as embodied in preferred forms of construction, it will be understood that various modifications may be made in the structure and arrangement of the parts without departing from the spirit and the scope of the invention recited in the following claims.

What we claim is:

1. An applicator for applying a cosmetic to a skin surface, comprising:

a handle having a longitudinal axis and opposite ends;

a first rolling member having a concave application surface and a first axial dimension, the first rolling member mounted at one end of the handle for rotation about a fixed axis extending laterally of the longitudinal axis of the handle;

not more than one second rolling member having a convex application surface and a second axial dimension, wherein the second rolling member is a wheel enabled for biaxial rotation or wherein the second rolling member is a ball, the second rolling member rotatably mounted at the opposite end of the handle; and means for mounting the first and second rolling members to respective opposite ends of the handle;

wherein a ratio of the first axial dimension to the second axial dimension is in the range of from about 5:1 to about 2:1, and wherein the respective application surfaces of the first and second rolling members are configured to uniformly apply, distribute and blend the cosmetic on the skin surface of a user's face and neck.

2. The applicator of claim 1, wherein the means for mounting the first rolling member to the handle comprises at least one support having a rolling member-engaging end and a handle-engaging end and at least one supporting member for the first rolling member extending from the rolling member-engaging end of the support allowing for rotation of the first rolling member, and wherein the means for mounting the second rolling member to the handle comprises at least one support having a rolling member-engaging end and a handle-engaging end and at least one supporting member for the second rolling member extending from the rolling member-engaging end of the support allowing for rotation of the second rolling member.

3. The applicator of claim 2, wherein the at least one support is individually selected from the group consisting of one-armed and two-armed supports.

4. The applicator of claim 2, wherein the supporting member is selected from the group consisting of axles, pins, shafts, spindles, magnetic connectors and cooperatively mating structures.

5. The applicator of claim 2, wherein the means for mounting at least one of the first and the second rolling members to the handle comprises a yoke having a rolling member-engaging end and a handle-engaging end, the rolling member-engaging end comprising a pair of spaced arms, the spaced arms being adapted to accommodate the rolling member.

6. The applicator of claim 5, wherein the means for mounting the first rolling member to the end of the handle comprises a first yoke having a rolling member-engaging end and a handle-engaging end, the rolling member-engaging end comprising a first pair of spaced arms separated by a first distance d1, the first pair of spaced arms being adapted to accommodate the first rolling member, and wherein the means for mounting the second rolling member to the handle comprises a second yoke having a rolling member-engaging end and a handle-engaging end, the rolling member-engaging end comprising a second pair of spaced arms separated by a second distance d2, the second pair of spaced arms being adapted to accommodate the second rolling member, wherein a ratio of d1:d2 is in the range of from about 5:1 to about 2:1.

7. The applicator of claim 6, wherein the second rolling member is the wheel enabled for biaxial rotation, and the applicator further comprises means for mounting the second yoke to the handle, said means allowing the second yoke to rotate freely about its longitudinal axis at an abutment of the second yoke with the handle.

8. The applicator of claim 6, wherein said means for mounting the first rolling member between the spaced arms of the first yoke further comprises a supporting member for the first rolling member allowing for rotation of the first rolling member and said means for mounting the second rolling member between the spaced arms of the second yoke further comprises a supporting member for the second rolling member allowing for rotation of the second rolling member, and wherein said supporting member is selected from the group consisting of axles, pins, shafts, spindles, magnetic connectors and cooperatively mating structures.

9. The applicator of claim 8, wherein said supporting member for the first rolling member and said supporting member for the second rolling member comprise cooperatively mating structures, and wherein the first rolling member has opposite surfaces and each of the spaced arms of the first yoke has inner surfaces, and said cooperatively mating structures for mounting the first rolling member between the first pair of spaced arms comprise a first pair of projections on one of the opposite surfaces of the first rolling member and the inner surfaces of the spaced arms of the first yoke, and a first pair of recesses in the other of the opposite surfaces of the first rolling member and the inner surfaces of the spaced arms of the first yoke, and wherein the second rolling member has opposite surfaces and each of the spaced arms of the second yoke has inner surfaces, and said cooperatively mating structures for mounting the second rolling member between the spaces arms of the second yoke comprises a second pair of projections on one of the opposite surfaces of the second rolling member and the inner surfaces of the spaced arms of the second yoke, and a second pair of recesses in the other of the opposite surfaces of the second rolling member and the inner surfaces of the spaced arms of the second yoke.

10. The applicator of claim 7, wherein the wheel enabled for biaxial rotation has a flocked application surface.

11. The applicator of claim 7, wherein said means for mounting the second yoke to the handle is selected from the group consisting of a gimbal mount, a universal joint, a knuckle joint, and a dual joint.

12. The applicator of claim 11, wherein said means for mounting the second yoke to the handle comprises a dual joint, the dual joint comprising an annular projection on one of the second yoke and the handle and a sleeve on the other of the second yoke and the handle, wherein the sleeve comprises an inner wall dimensioned to accommodate the projection in mating engagement.

13. The applicator of claim 12, wherein the sleeve inner wall further comprises an annular ledge for maintaining the projection in snap-fitting engagement with said sleeve.

14. The applicator of claim 2, wherein the at least one support for the first rolling member and the at least one support for the second rolling member are aligned with the longitudinal axis of the handle.

15. The applicator of claim 2, wherein the at least one support for the first rolling member and the at least one support for the second rolling member are offset from the longitudinal axis of the handle in the same direction.

16. The applicator of claim 2, wherein the at least one support for the first rolling member and the at least one support for the second rolling member are offset from the longitudinal axis of the handle in opposite directions.

17. The applicator of claim 2, wherein one of the at least one support for the first rolling member and the at least one support for the second rolling member is aligned with the longitudinal axis of the handle, and wherein the other of the at least one support for the first rolling member and the at least one support for the second rolling member is offset from the longitudinal axis of the handle.

18. The applicator of claim 1, wherein the first rolling member is axially symmetric and symmetric across its length and the second rolling member is axially symmetric and symmetric across its width.

19. The applicator of claim 1, wherein the second rolling member is a ball.

20. The applicator of claim 19, wherein the means for mounting the first rolling member to the handle comprises at least one support having a rolling member-engaging end and a handle-engaging end and at least one supporting member for the first rolling member extending from the rolling member-engaging end of the support allowing for rotation of the first rolling member, and wherein the means for mounting the ball to the handle comprises at least one support extending from the handle and allowing for rotation of the ball.

21. The applicator of claim 20, wherein the means for mounting the first rolling member to the handle comprises a yoke having a rolling member-engaging end and a handle-engaging end, the rolling member-engaging end comprising a pair of spaced arms for accommodating the first rolling member, and wherein the means for mounting the ball to the handle comprises a socket provided by an expanded end of the handle for pivotally accommodating the ball.

22. The applicator of claim 20, wherein the means for mounting the first rolling member to the handle comprises a yoke having a rolling member-engaging end and a handle-engaging end, the rolling member-engaging end comprising a pair of spaced arms for accommodating the first rolling member, and wherein the means for mounting the ball to the handle comprises a loop element provided at an end of the handle for pivotally accommodating the ball.

23. The applicator of claim 1, wherein the handle is contoured to facilitate grasping by a user.

24. The applicator of claim 1, wherein the first and second rolling members have surfaces individually selected from the group consisting of flocked, textured and smooth.

* * * * *